US006370993B1

(12) United States Patent
Pitstick

(10) Patent No.: US 6,370,993 B1
(45) Date of Patent: Apr. 16, 2002

(54) SPRING LOADED SELF ACTUATING IMPACT DRIVER

(76) Inventor: Martin H. Pitstick, 4068 Elvista Dr., Cleves, OH (US) 45002

( * ) Notice: Subject to any disclaimer, the term of this patent is extended or adjusted under 35 U.S.C. 154(b) by 0 days.

(21) Appl. No.: 09/615,863

(22) Filed: Jul. 13, 2000

Related U.S. Application Data

(60) Provisional application No. 60/143,583, filed on Jul. 13, 1999.

(51) Int. Cl.[7] ..... B25B 19/00

(52) U.S. Cl. ..... 81/463; 173/93.6; 173/203

(58) Field of Search ..... 81/463, 465, 466, 81/DIG. 2, DIG. 5; 173/93, 93.7, 202, 203, 120, 121, 93.6

(56) References Cited

U.S. PATENT DOCUMENTS 1,860,871 A * 5/1932 Pouliot ..... 81/DIG. 5
2,576,069 A * 11/1951 Hoag et al. ..... 81/DIG. 5
3,337,014 A * 8/1967 Sandrick ..... 81/DIG. 5
4,919,216 A * 4/1990 Ikegami ..... 173/93.6
5,495,783 A * 3/1996 Slusar et al. ..... 81/DIG. 5

* cited by examiner

*Primary Examiner*—D. S. Meislin

(74) *Attorney, Agent, or Firm*—Wood, Herron & Evans LLP

(57) ABSTRACT

A self-contained impact driver includes an internal hammer, hammer spring and trigger. Pressing the driver against a fastener compresses the spring progressively until the end of the stroke, at which time the hammer is released by the trigger. The trigger both compresses the hammer spring, and releases it. Rotary impact force is applied to the fastener in a selected clockwise or counterclockwise direction.

9 Claims, 5 Drawing Sheets

SPRING LOADED SELF ACTUATING IMPACT DRIVER

Benefit is claimed of the filing date of Jul. 13, 1999 which is the filing date of applicant's provisional patent application, U.S. Ser. No. 60/143,583 entitled SPRING LOADED, SELF ACTUATING IMPACT DRIVER, which application is expressly incorporated herein by reference.

This invention relates to an impact driver and, more particularly, to an impact driver which does not rely on an external strike to cause the driver to operate.

Rotary impact drivers are well known. These are used to loosen or tighten fasteners which are stuck or which require significant torque in their operational placement or removal. In these devices, a durable handle houses a spring and a bit holder. A cam drives the bit holder.

When operated, a bit is inserted onto a fastener which may be a Phillips screw, a slotted screw, a hex head or any other rotary fastener for which a bit is provided. The rear end of the handle is struck by a discrete, manually-held mallet or hammer to provide a rotationally directed impact on the fastener. The blow serves to produce a force into the fastener as well as a rotational impact force thereon.

Depending on the size and other parameters of the fastener and its application, such a blow having the force of a discrete hammer or mallet may not be necessary. In many applications, while a rotational impact on the fastener is helpful, it may not require the extreme force of such a blow.

It is thus desirable to provide an impact apparatus which eliminates the necessity of striking an impact tool with a discrete hammer. It is another objective of the invention to provide an impact driver which is capable of imparting a rotational impact to a fastener but without a blow from a discrete hammer.

It is yet a further objective of the invention to provide a self-contained or self-actuating rotary impact driver where manipulation of the tool itself generates the rotational impact without requiring that the tool be struck by a hammer.

To these ends, an impact tool according to the invention includes an internal spring-loaded hammer within the tool. Manual compression of the tool toward a fastener loads the spring until a trigger mechanism releases the hammer to drive a cam housing forwardly and the associated bit holder both into the fastener and rotationally. Thus, a manual, linear pushing motion is converted into a rotational impact force. A manually adjustable screw mechanism is used to provide pre-load adjustment for the hammer spring. Also, a reversing apparatus is operable by manual rotation of the bit housing to reverse the rotary impact direction to selectively create forward or reverse drive direction for the same manual actuating push toward the fastener.

These and other objectives and advantages will become readily apparent from the following detailed description of a preferred embodiment of the invention and from the drawings in which:

Figure 1:
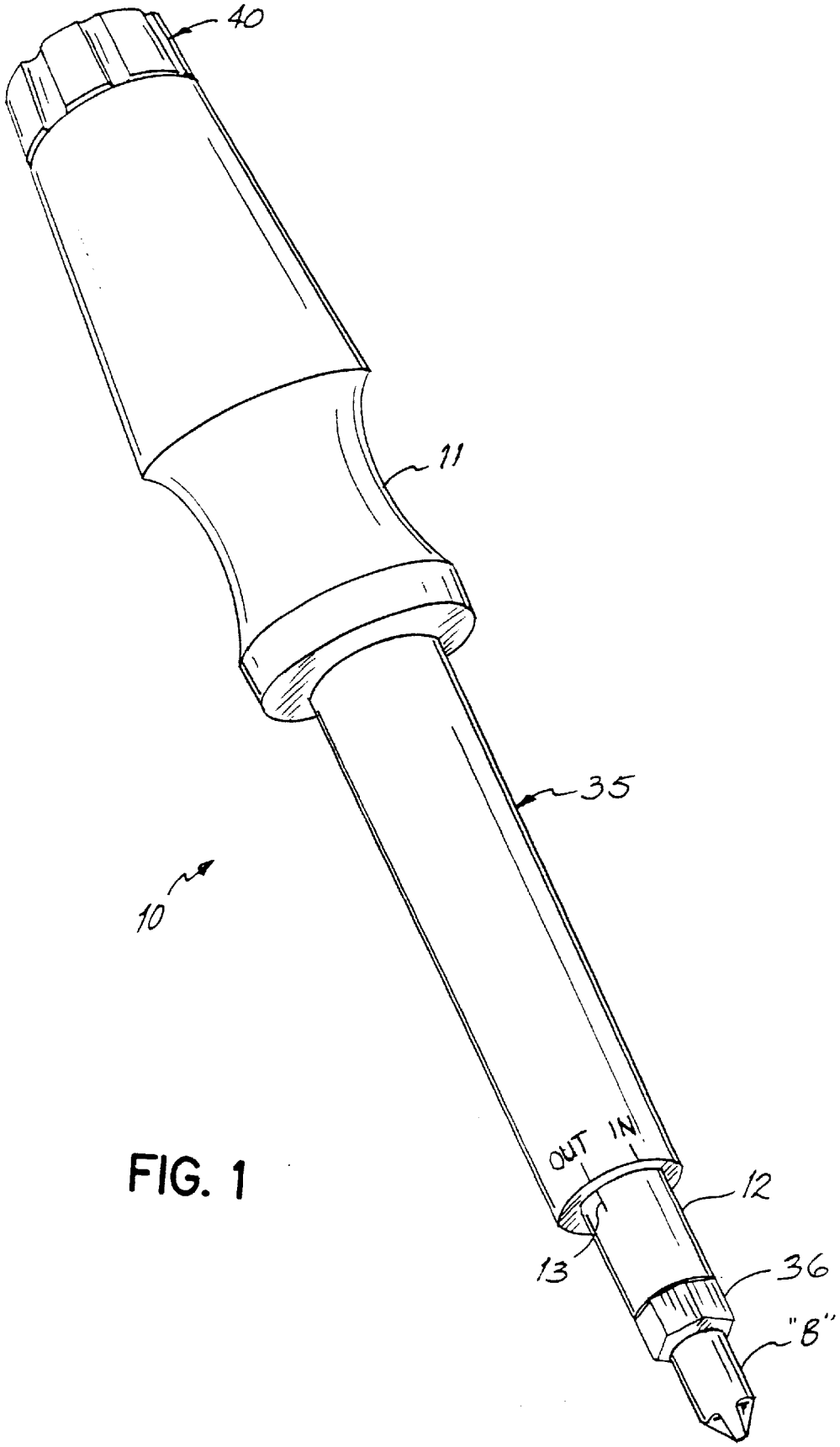
FIG. 1 is a perspective view illustrating the tool of the invention.

Turning now to the figures, there is shown in FIG. 1 a self-contact impact tool 10 according to the invention and having a soft handle 11 and an outer housing 35 extending forwardly therefrom. A rotational bit housing 12 extends forwardly of outer housing 35 and releasably mounts on an appropriate driver bit or socket such as bit "B". Fastener out and fastener in markings (FIG. 1) are applied to the outer housing 35 for indexing with a mark 13 on the rotational bit housing 12.

Internal components of tool 10 are best seen in FIGS. 2–7. Outer housing 35 is preferably secured to handle 11 by threads illustrated at 14. Handle 11 is hollow, as is outer housing 35.

A cammed housing 15 (FIGS. 6–7) has a bore 16 housing a compressible shock spring 17 of any appropriate gauge and coil number. Rotational bit housing 12 is disposed within cammed housing 15 capturing shock spring 17 therein.

Helical or other shaped slots 21*a* and 21*b* are provided on opposite sides of cammed housing 15 and receive a pin 18 extending through rotational bit housing 12. Pin 18 moves into one side or the other of the respective helical slots 21*a*, 21*b* by manual selection to select either clockwise or counterclockwise rotation of rotational bit housing upon operation of tool 10 as will be described.

One or more sets of splines or grooves 22 are disposed in the forward end of the outer housing 35 to cooperate with one or more external splines (not shown) or grooves on the cammed housing 15 to enable it to translate axially, but not move rotationally. When the tool is assembled, shock spring 17 urges the bit housing 12 in a forward direction from cammed housing 15.

A push trigger 19 (FIG. 2) has a rounded engagement nose 23 and a rearwardly directed flat or rod-like stem 24 extends rearwardly from a centering boss 25 on the trigger 19 to an end 29. Boss 25 has a frusto-conically shaped surface 26. A trigger spring 27 urges the stem 24 in a radial, off-axis direction, toward an internal wall of the outer housing 35.

Figure 2:
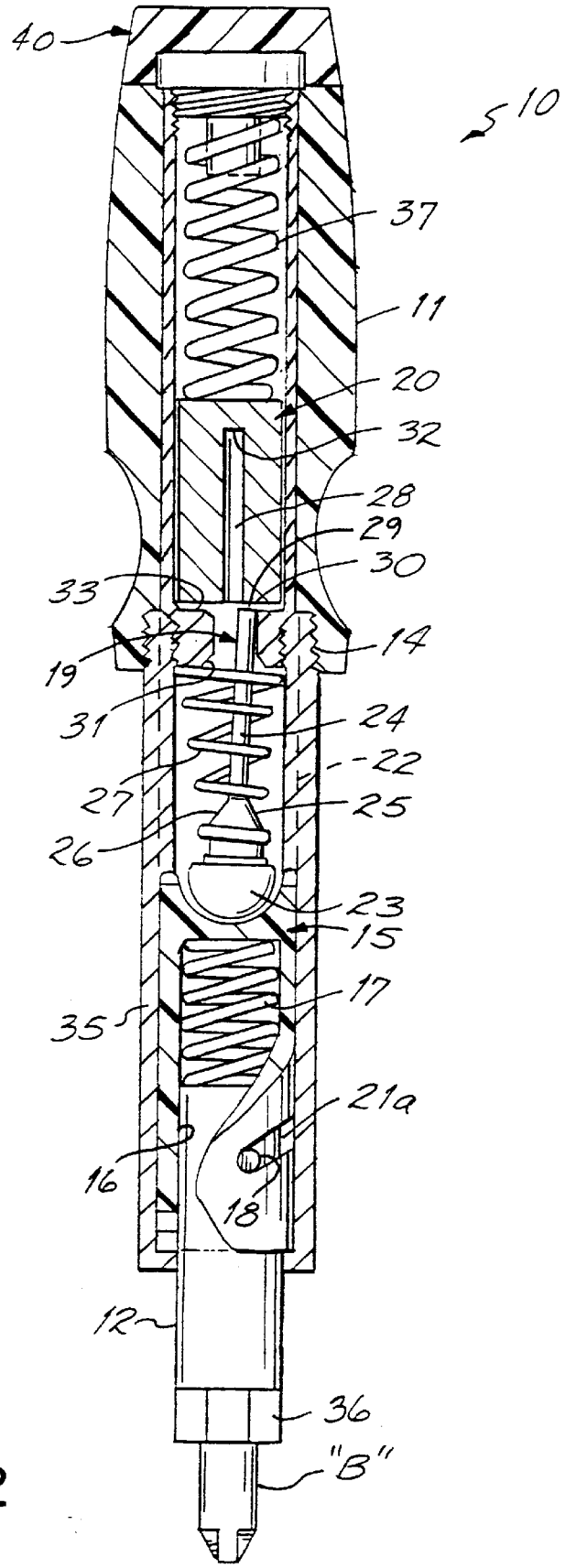
FIG. 2 is a cross-sectional view illustrating details and components of the tool of FIG. 1.

The soft handle 11 houses an internal hammer 20 and hammer spring 37. Hammer 20 has an axially extending bore or slot 28 preferably corresponding in shape with stem 24 of trigger 19. Bore 28 has a blind end 32. Hammer 20 includes a face 30 and provides a hammer stop surface for engagement with shoulder surface 33 in handle 11. Handle 11, as shown in FIG. 2, also incorporates a tapered seat 31 preferably configured similar to surface 26 on trigger 19, as will be described.

At the forward end of the tool, a magnetic bit receiver 36, or any other form of bit receiver, is attached to the rotational bit housing 12. When that housing rotates, it carries the bit receiver 36 and any bit "B" or socket therein in the same direction, motivated by slot 21*a* or 21*b* and the cammed pin 18.

Figure 3:
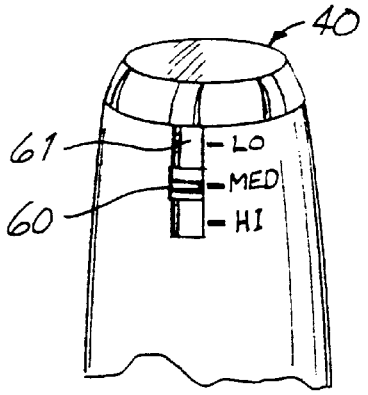
FIG. 3 is a partial elevation a view of the upper end of the handle of the tool of FIGS. 1 and 2.
Figure 4:
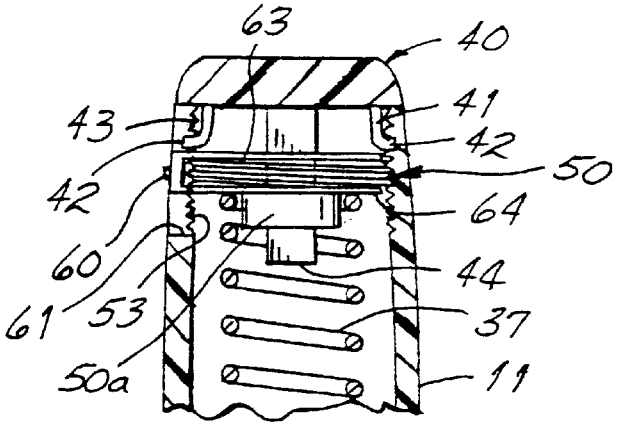
FIG. 4 is a cross-sectional view of the components of FIG. 3.
Figure 5:
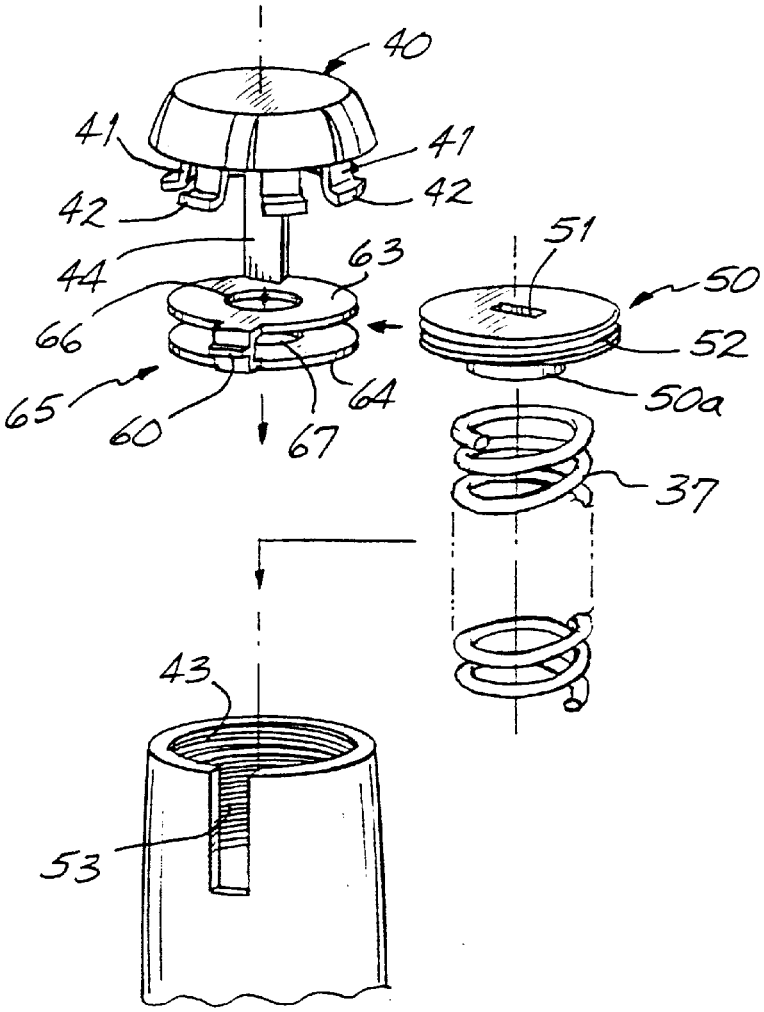
FIG. 5 is an exploded view of the components of FIGS. 3 and 4.
Figure 6:
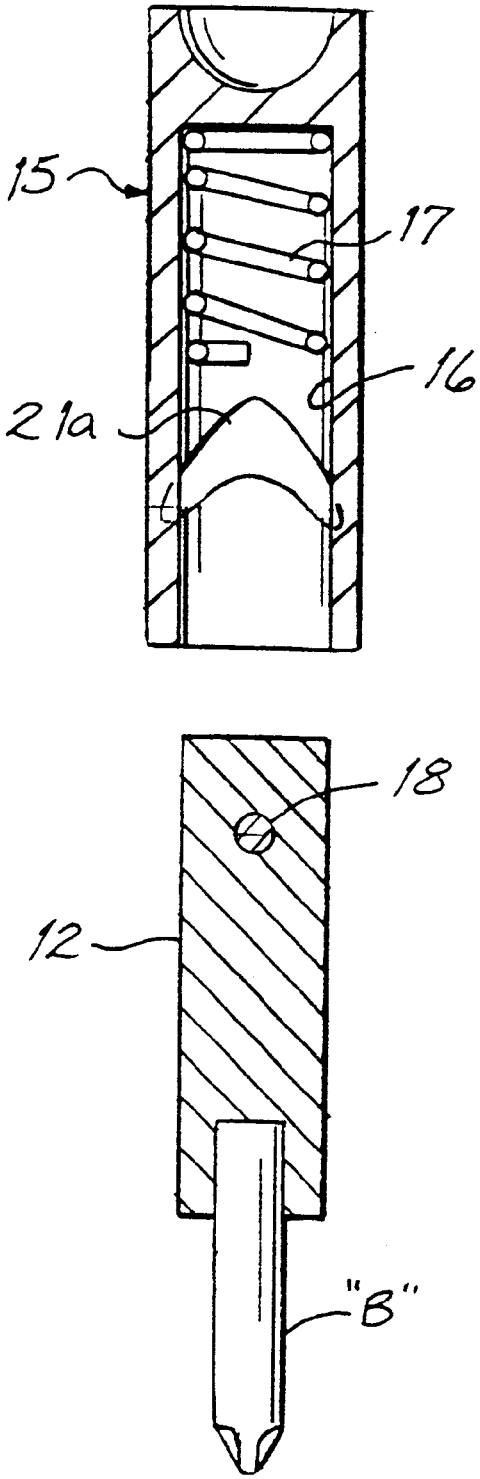
FIG. 6 is a cross-sectional view of the cammed housing and bit housing of FIGS. 1 and 2.
Figure 7:
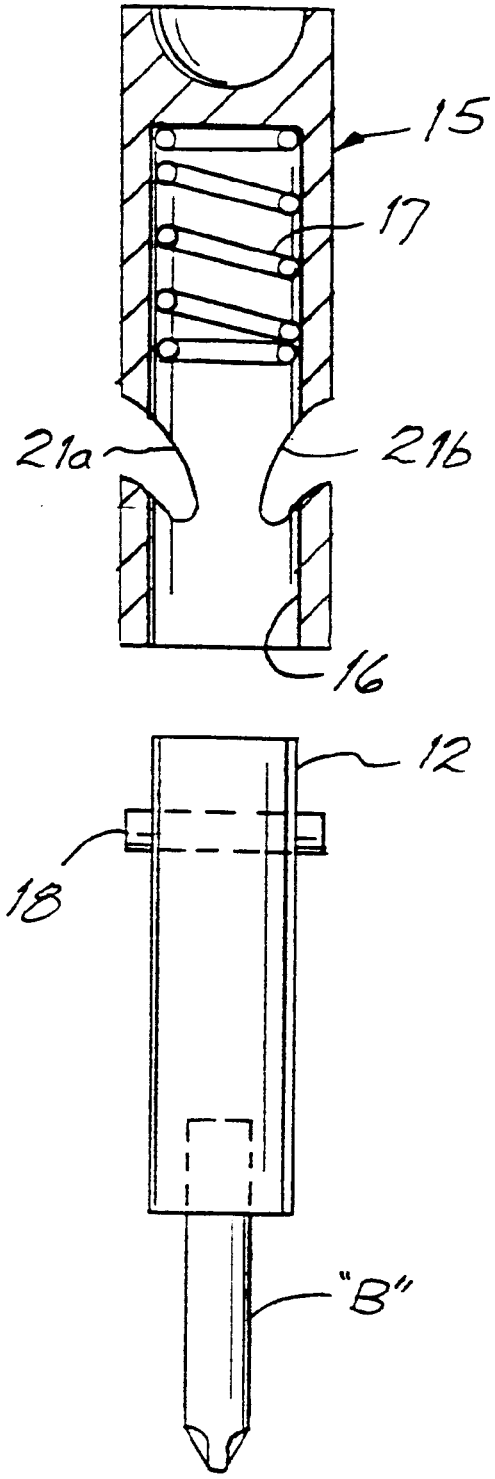
FIG. 7 is a cross-sectional view similar to FIG. 6 but shown at 90 degrees with respect thereto.
Figure 8:
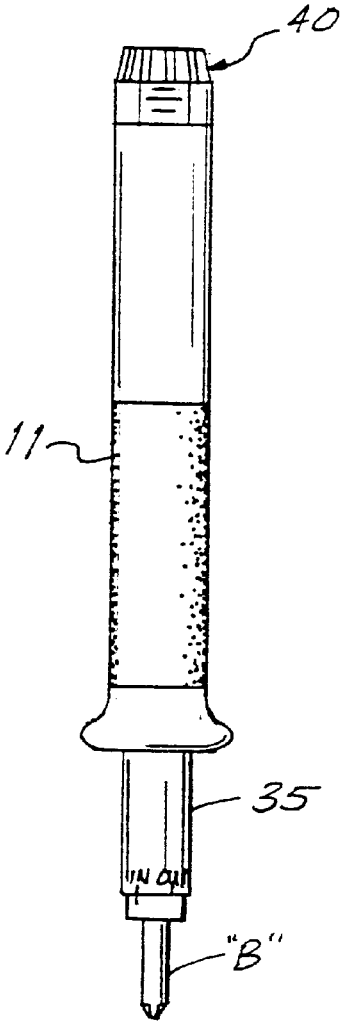
FIG. 8 is an elevational view of a small driver according to the invention.

Referring to FIGS. 3–5, the tool's soft handle 11 is provided with an adjusting knob 40. Knob 40 is provided with a plurality of tabs 41, each having an outwardly turned flange 42. Flanges 42 ride in a groove 43 provided in the interior cylindrical surface of the handle to capture it. The knob 40 is rotatable, but is not movable in an axial direction along the elongated axis of the tool 10.

A drive blade or tab 44 extends axially into the tool handle from knob 40. Blade 44 is a flat-shaped member preferably, but other shapes could be used.

An externally-threaded spring compressor disk 50 is provided with a slot-shaped aperture 51 for receiving blade 44. When knob 40 and thus blade 44 turn, the disk 50 is rotated.

Disc 50 is provided with external threads 52 cooperating with internally facing threads 53 in the handle 11. When knob 40 and disc 50 turn, the disc 50, but not the knob 40, translates or moves in an axial direction along the elongated axis of the tool. Of course, the disc 50 moves axially along the blade 44.

Movement of the disc 50 toward the hammer spring 37 compresses and pre-loads that spring 37 so that its eventual force is increased. Movement of disc 50 in an opposite direction unloads the hammer spring 37 so that its eventual force is decreased. A shoulder, 50*a,* on disc 50 is inserted in the end of the hammer spring 37, acting as a spring guide to keep that spring centered.

In order to indicate the degree of pre-load on the hammer spring, a pre-load indicator 60 is disposed in an extended slot 61 in the handle and through the handle wall.

Indicator 60 is preferably formed integrally as a connector between two washer-shaped members 63, 64 defining, with indicator 60, an indicator collar 65. The circumference and diameter of disc 50 is such that it generally extends slightly outwardly (radially) from the outer circumferential edges of washers 63, 64. Disc 50 resides between washers 63, 64 and is free to rotate with respect thereto.

Washer members 63, 64 are provided with apertures 66, 67 to accommodate blade 44 without turning when the blade 44 turns, and collar 65 is translatable axially.

Since the indicator 60 rides in slot 61, since washer members 63, 64 are less than coextensive with disc 50, and since the collar 65 can move axially, rotation of knob 40 to turn blade 44 and move disc 50 axially, also causes indicator 60 to move in a direction parallel to the elongated tool axis. Markings on the handle next to slot 61 (FIG. 3) thus indicate the position of indicator 60 and the high, medium or low pre-load condition of the hammer spring 37 as a function of the position of disc 50 in the handle and with respect to the position of the loaded or unloaded spring 37.

Figure 9:
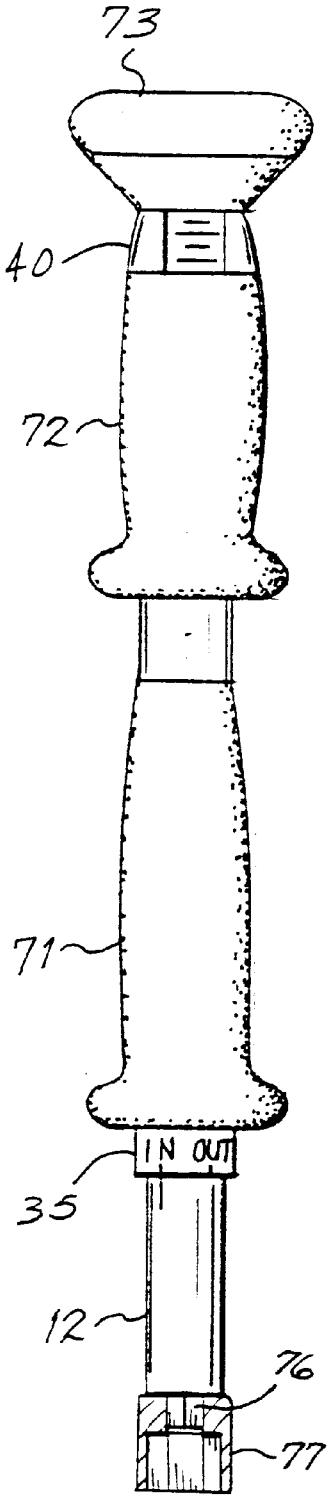
FIG. 9 is an elevational view of a larger impact driver according to the invention.

The driver can be made in any suitable size. In one configuration (with similar numbers for similar parts), it can be pencil-sized (about 5½ inches long) for small work, jewelry, watches, glasses, etc. In another application (with similar numbers for similar parts), it can be made larger (about 14 inches long) and provided with two hand grips 71, 72 around its handle, a body or knee pad 73 on the handle end for application of higher force, and a 3/8 or ½ inch square drive end 76. (FIG. 9) for a socket 77, for example. In both embodiments, similar hammer spring pre-load adjustment structure can be used, or any other suitable adjustment mechanism for adjusting the pre-load on spring 37.

Turning to the operation of the invention, the hammer spring 37 is pre-loaded to a desired condition (less than the preset pre-load of the shock spring 17). An appropriate bit "B" or socket is selected and mounted and the tool 10 positioned over the workpiece or fastener.

The tool is then manually pushed toward the fastener. This motion compresses the hammer spring 37 by virtue of the engagement of the rear end 29 of stem 24 on the forward face 30 of the hammer. The trigger spring 27 is also compressed. It will be appreciated that during this compression, the handle 11 and outer housing 35 are moved forwardly over the rotational bit housing 12, causing the handle 11 to turn slightly as it moves forwardly, depending on the slope of respective slot 21*a* or 21*b* in which pin 18 resides.

When the tool 10 is substantially forward, with spring 37 compressed, the centering boss 25 of trigger 19 is moved into the tapered seat 31. This axially indexes stem 24 against the bias of the trigger spring 27 and into a coaxial position with respect to the tool 10 and, more importantly, bore 28 in internal hammer 20. When the end 29 of stem 24 is axially oriented, it falls off the face 30 of the hammer 20 into slot or bore 28. The hammer is released and falls onto the stem 24. When the end 29 of stem 24 is hit by the blind end 32 of the slot or bore 28 of hammer 20, the stem 24 and nose 23 thereon are driven forwardly by the force of the pre-loaded and now compressed hammer spring 37. This forward blow or impact force is transmitted through the stem 24 to nose 23 and to the cammed housing 15 which is driven sharply forwardly, and rotationally depending on which side of slots 21*a,* 21*b* pin 18 resides.

Of course, any suitable mechanism could be used to compress and release the hammer 20 on manual operation of the handle 11. Likewise, any centering device such as a ramp, or other centering mechanism or release mechanism for the trigger stem 24 could be used.

As the cammed housing 15 is moved forwardly, it is restrained from rotation by its external spline or splines 22. Slots 21*a,* 21*b* also move forwardly with the cammed housing and drive the cammed pin, rotational bit housing 12, bit receiver 36 and bit "B" therein rotationally with an impact force which is imparted to the fastener. The hammer 20 may be arrested in its forward motion by its face 30 and shoulder 33.

Once the stem end 29 clears the slot or bore 28 (the trigger spring 27 biases it forwardly) the radial bias of the trigger spring 27 moves the stem 24 in a radial direction, offsetting it axially and from slot or bore 28 as show n in FIG. 2, and resetting the tool 10 for another cycle.

Since the hammer spring 37 is pre-loaded less than the shock spring 17, the hammer spring is compressed by manipulation of the tool. When the hammer is released to fall on the stem 24, the force or blow is thus cushioned by the shock spring. Selection of hammer spring 37 and shock spring 17 are thus selected as a function of the typical impact drive operation to be produced and can be of any suitable cooperating parameters.

Of course, various bits, tool sizes and components can be used for particular applications. Also, slots 21*a* and 21*b* can be inclined or configured for providing particular rotational driving parameters. Reversal of the drive direction is produced by twisting the rotational bit housing to line up index mark 13 with the appropriate indication on housing 35 (FIG. 1). Preferably the two slots have a common area to allow positioning of the cammed pin in the selected slot for rotation in the proper direction. As described, markings on the respective outer housing 35 and on the rotational bit housing indicate whether the tool operation will turn a bit "in" toward (forward) the workpiece or "out" away from the workpiece (rearward).

In summary, the primary purpose or function of the spring loaded impact driver is the removing or driving of fasteners that are difficult or stuck and require a high degree of torque or impact shock, but yet preferably without an external blow. The tool allows a push motion to be converted into a rotational impact force.

The push motion loads an internal spring. At a preset location, a trigger mechanism releases the loaded spring driving a hammer. The hammer then strikes an internal cammed housing creating a rotational impact shock. The driver design allows for multiple driver and bit configurations. The driver has a manually adjustable screw mechanism which allows the user to change the hammer spring pre-load. The driver bit housing can be rotated in order to create a forward or reverse drive direction. Also, handles 11, 71, 72 can be of any suitable material, such as soft synthetic or rubber compound.

These and other modifications and advantages will become readily apparent to those of ordinary skill in the art and applicant intends to be bound only by the claims appended hereto.

I claim:

1. A rotary impact tool for driving fasteners and comprising:

a handle;

an outer housing;

said handle and said outer housing being screwed together;

a spring-loaded hammer disposed for reciprocating movement within said handle;

a cammed housing disposed in said outer housing and having a cam slot, said cammed housing movable axially but not rotationally in said outer housing; a bit housing;

a pin extending from the bit housing into said cam slot; and a trigger comprising an elongated stem for urging said spring-loading hammer into a compressed condition when said tool is manually pushed toward a fastener, and for releasing said hammer to drive said cammed housing and impart a rotational impact force to said fastener through said bit housing;

said hammer remaining within said handle throughout its reciprocating movement.

2. A rotary impact tool as in claim 1 wherein said trigger stem is offset axially for compressing said spring-loaded hammer and further including a centering means for axially aligning said stem to release said hammer.

3. A rotary impact tool as in claim 2 including a yieldable spring biasing said trigger stem into an offset axial position.

4. A rotary impact tool as in claim 1 including an adjustment knob and an indicator proximate the handle to adjust and indicate, respectively, a spring pre-load on the hammer.

5. A rotary impact tool as in claim 1 including respective indicia on the bit housing and on the tool cooperating to indicate operational tool direction, upon release of said hammer.

6. A rotary impact tool as in claim 2 wherein said centering means comprises, in part, a tapered surface defined within an area overlapped by said handle and by said outer housing.

7. A rotary impact tool as in claim 6 wherein said handle includes an inner cylinder, said tapered surface comprising a portion of said inner cylinder.

8. A rotary impact tool as in claim 7 further including a hammer stop defined in an end of said inner cylinder.

9. A rotary impact tool as in claim 1 further including an inner cylinder in said handle, said inner cylinder having a distal end comprising a hammer stop and further also comprising a hammer stop and further also comprising a portion of a means for centering said stems to release said hammer.

* * * * *